US005275518A

United States Patent [19]

Guenther

[11] Patent Number: 5,275,518

[45] Date of Patent: Jan. 4, 1994

[54] HAND RAIL FASTENER

[75] Inventor: Torbett B. Guenther, Plymouth, Mich.

[73] Assignee: C. D. Sparling Company, Plymouth, Mich.

[21] Appl. No.: 11,267

[22] Filed: Jan. 29, 1993

[51] Int. Cl.[5] ..... F16B 13/04; F16B 21/00

[52] U.S. Cl. ..... 411/38; 411/55; 411/344

[58] Field of Search ..... 411/34, 36, 37, 38, 411/55, 340, 344, 345, 346

[56] References Cited

U.S. PATENT DOCUMENTS

| | | | |
|---|---|---|---|
| 3,288,014 | 11/1966 | Mortensen | 411/344 |
| 4,439,079 | 3/1984 | Losada | 411/345 |
| 4,453,869 | 6/1984 | Cremieux | 411/344 X |
| 4,502,826 | 3/1985 | Fafard | 411/340 |
| 4,650,386 | 3/1987 | McSherry et al. | 411/344 |

*Primary Examiner*—Neill R. Wilson
*Attorney, Agent, or Firm*—Barnes, Kisselle, Raisch, Choate, Whittemore & Hulbert

[57] ABSTRACT

A plastic fastener for mounting a hand rail to a thin wall such as a tub or shower wall is provided for which comprises a rigid anchor bar having a substantially flat bearing surface to engage a back surface of the wall and which has an arcuate length for installation in narrow spaces. The plastic fastener is molded in a flat condition and comprises a fastening head integrally connected to the anchor bar by a flexible strap. The anchor bar has a transverse slot to define a rigid block and an interconnecting flexible hinge. The plastic fastener includes a bolt adapted to extend through an opening in the fastening head and to be threaded into an opening in the anchor bar as the plastic fastener is bent about the flexible hinge to form a fastener assembly. The fastener assembly is mounted to the wall so that the anchor bar is inserted through an opening in the wall to extend behind the wall as the fastening head is maintained within the opening. As the bolt is advanced, the fastening head is drawn toward the anchor bar as the flexible strap collapses. The anchor bar with the hinged block provides a bearing surface across the opening in the wall sufficient to resist forces applied to the hand rail. The fastening head includes an indicator to locate the center axis of the anchor after installation for positioning the anchor bar at a maximum load bearing position.

19 Claims, 2 Drawing Sheets

HAND RAIL FASTENER

This invention is directed to a fastener and more particularly to a fastener for attaching a hand rail to a thin tub or shower wall.

BACKGROUND OF THE INVENTION

Wall bars and hand rails have heretofore been known. For example, U.S. Pat. Nos. 4,193,586 and 4,415,141 disclose such typical supports. These devices are generally mounted to the wall by screws. However, screw mountings may not provide adequate strength in connecting the support bar to the wall due to the generally small bearing surfaces between the fastener and the thin wall when a large amount of force is applied to the support bar.

Fasteners have been known which maintain a bearing on an inside surface of a wall opposite that to which the work is held to provide greater support. For example, U.S. Pat. Nos. 1,386,202; 2,408,366 and 2,504,325 disclose such fasteners. These fasteners; however, are not adapted to mount objects to a thin wall, such as a tub or shower wall, where there is extremely limited space behind the thin wall.

The present invention overcomes the above mentioned problems by providing a greater bearing surface against the thin wall giving greater mounting strength to support greater loads, which can be installed in very limited spaces, is easy to manufacture and is simple to install.

SUMMARY OF THE INVENTION

In accordance with the invention, the fastener comprises a curved rigid anchor bar having a substantially flat bearing surface adapted to be inserted through an opening and engage along a back surface of a thin wall. The fastener is molded in a flat condition where the anchor bar is connected to a fastening head through a flexible strap. The anchor bar has a rigid block at one end connected thereto by a flexible hinge. The fastener is bent at the flexible hinge to accommodate a bolt adapted to extend through an opening in the fastening head and threaded through an opening in the anchor bar to form a fastener assembly. The anchor bar is inserted through the opening in the wall and manipulated so that the fastening head is accommodated therein. As the blot advances, the hinged block straightens out to provide a rigid bearing surface across the opening as the flexible strap collapses. An indicator provided on the fastening head to indicate the position of the anchor bar after installation for positioning the anchor bar at a maximum load bearing position.

DESCRIPTION

Figure 1:
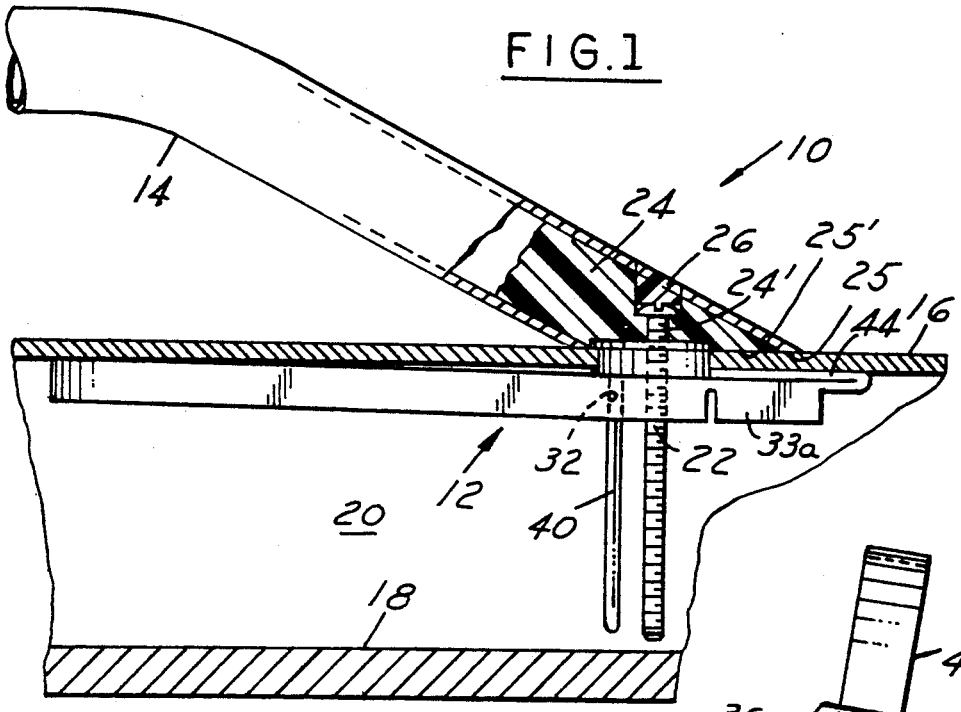
FIG. 1 is a fragmentary sectional view of a hand rail mounted to a thin wall with a fastener of the present invention.

Referring to FIG. 1, an assembly 10 is shown in which a fastener 12 connects a hand rail 14 to a thin wall 16, such as a tub or shower wall. The hand rail 14 is generally of the type having a single length of tubular material such as stainless steel of preferably substantial constant diameter. The end of the hand rail 14 has an insert 24 of solid plastic material with a threaded opening 24'. The hand rail 14 has an inclined end 25 and the insert 24 is similarly inclined at 25' thus forming a surface substantially parallel to the plane of the thin wall 16 for abutting engagement therewith. After mounting the hand rail 14 to the thin wall 16, the opening 24' may be filled with a plug 26 to hide the screw 22 for a more pleasing appearance.

It can thus be seen that in mounting such hand rails 14, the tub or shower wall is spaced only slightly from the wall 18 of the house leaving only a very narrow space 20. The fastener of the present invention is designed to be accommodated in such a narrow gap 20 as well as to provide a greater bearing surface against the thin wall 16.

Referring now to FIGS. 2–6, construction and installation of the fastener to a thin wall will now be described. The plastic fastener 12 is molded in a flat condition and comprises an arcuate rigid anchor bar 28, a fastening head 36 and a thin flexible strap 44 connecting the two.

The anchor bar 28 comprises a thick main body portion 33 having an arcuate length and a flat bearing surface 34. The body 33 is formed with a transverse slot 35 that defines a hinge 48. The transverse slot 35 further defines a block **33*a* connected to the body 33 by the hinge 48. The anchor bar 28 has a transverse threaded opening 30 and a transverse through opening 32 near the slot 35. The fastening head 36 comprises a transverse opening 38 therethrough and an integral retaining pin 40 extending from the lower surface thereof. The flexible strap 44 generally has a thin cross-section and is integrally connected at each end to the block 33*a* and the fastening head 36. The cross-section of the flexible strap 44 at each end is just slightly thicker than the length thereof to form a secure and stable connection with the block 33*a* and the fastening head 36. The fastening head 36 has a substantially D-shape as most clearly seen in FIGS. 2 and 4. A circumferential flange 42 extends about a substantial portion of the periphery of the fastening head 36. An indicator means such as, for example, a groove 36*a* defining a score line aligns with the axis of the anchor bar 28 to indicate the location of the anchor bar 28** after installation for purposes described below.

The fastener 12 further includes a bolt 22. The bolt 22 is adapted for connection to the fastening head 36 and the anchor bar 28 to form a fastener sub-assembly as seen in FIGS. 2–5. The sub-assembly is formed by bending the plastic fastener 12 about the hinge 48 so that the retaining pin 40 is aligned with the opening 32 in the anchor bar 28 and is then inserted therein. In this position, the opening 38 in the fastening head 36 is substantially aligned with the threaded opening 30. The bolt 22 is then inserted completely through the opening 38 so that the threaded end of the bolt 22 is received in and threaded into the threaded opening 30 to retain the fastening head 36 and the anchor bar 28 in a spaced relation.

Figure 2:
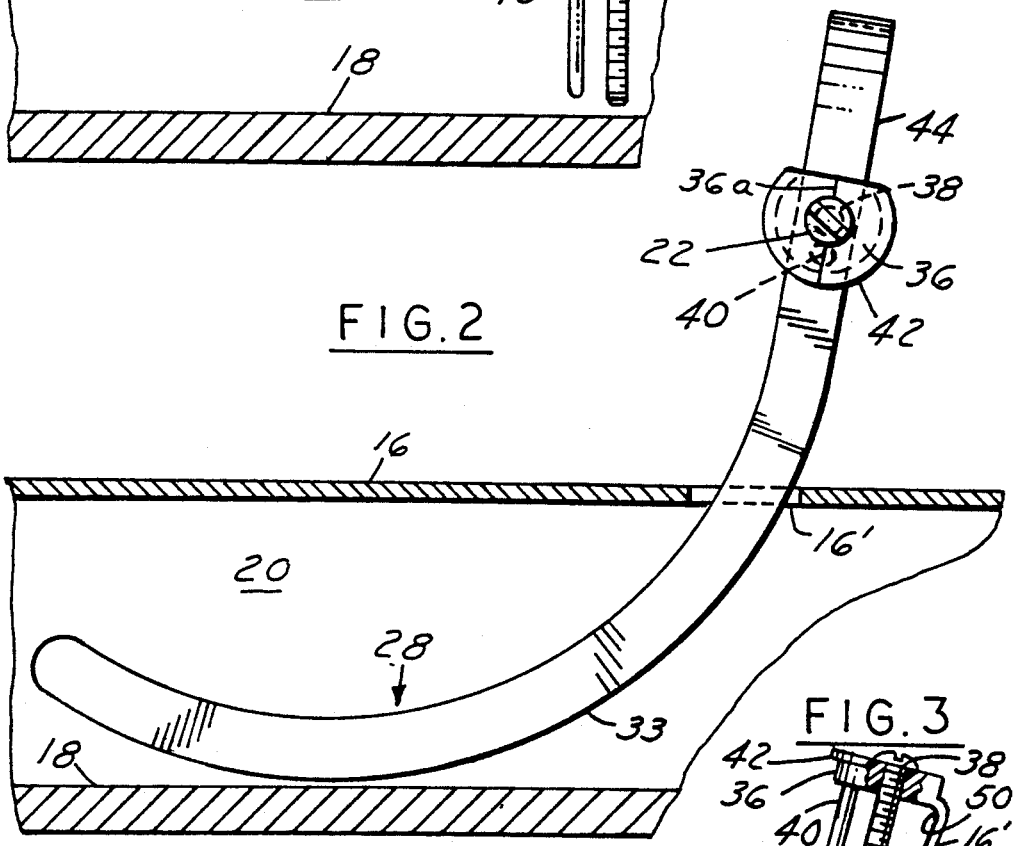
FIG. 2 is a fragmentary sectional view showing initial insertion of the fastener behind a thin wall.
Figure 3:
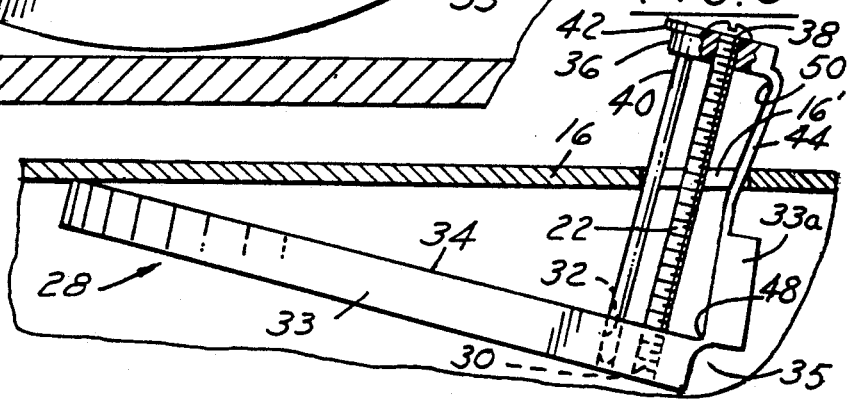
FIG. 3 is a fragmentary sectional view showing the anchor bar fully inserted behind a thin wall.
Figure 4:
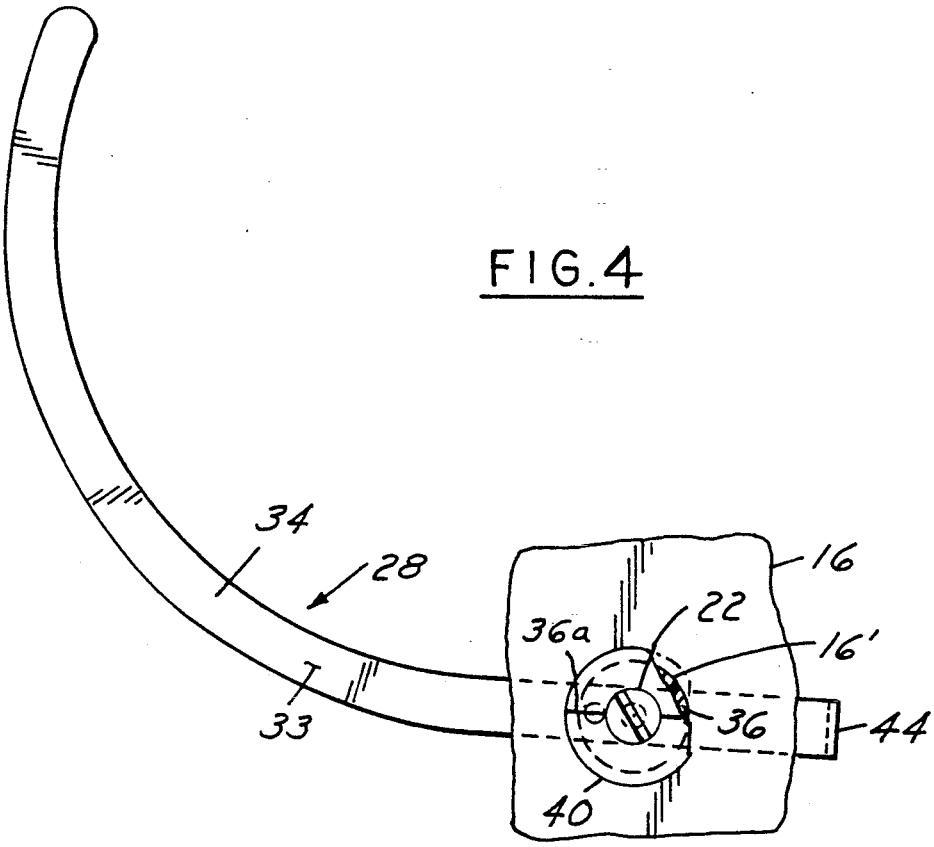
FIG. 4 is a fragmentary plan view of the fastener fully inserted behind a thin wall.

The sub-assembly is now ready for application to the tub or shower wall to which a hand rail is to be fastened. An opening 16' is formed in the wall 16. To apply the sub-assembly to the wall 16, the anchor bar 28 is inserted in the opening 16' as seen in FIG. 2. The arcuate configuration of the anchor bar 28 allows the entire length thereof to be inserted behind the wall 16 and within the narrow gap 20 between the wall 16 and wall 18. As soon as a substantial portion of the anchor bar 28 is behind the wall 16, the entire sub-assembly is rotated from the position shown in FIG. 2 so that the bearing surface 34 substantially faces the wall 16 as shown in FIG. 3. As the sub-assembly is inserted through the opening 16', the strap 44 flexes inwardly toward the bolt 22 to allow the strap 44, bolt 22 and retaining pin 40 passage through the opening 16'.

Figure 5:
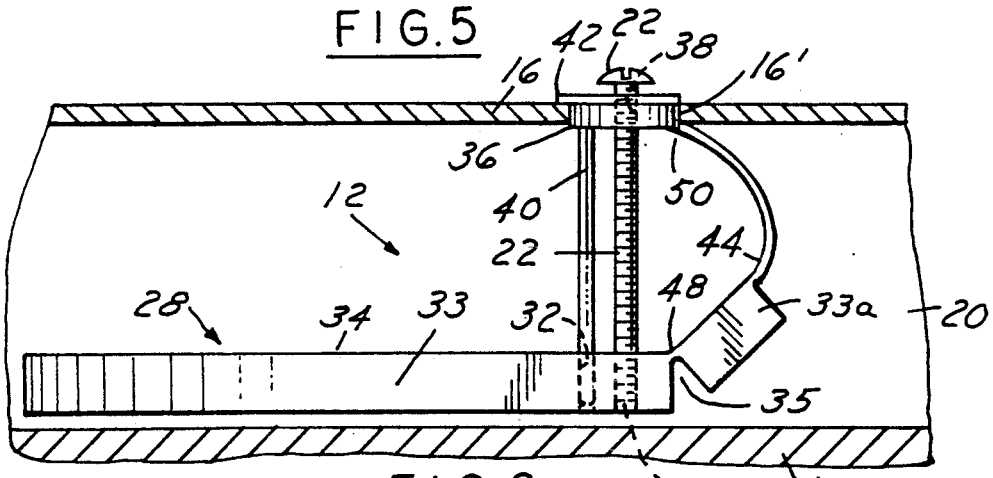
FIG. 5 is a fragmentary sectional view of the fastener in the fully extended position.
Figure 6:
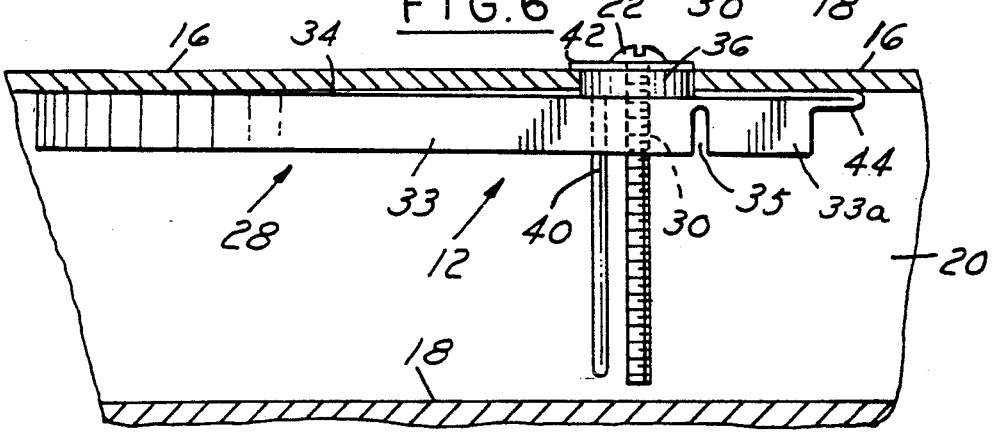
FIG. 6 is a fragmentary sectional view of the fastener in the collapsed position.

Once in the position of FIG. 3, the fastening head 36 is adapted to be accommodated within the opening 16' in the wall 16 as shown in FIG. 5. The circumferential flange 42 engages the outer surface of the wall 16 to prevent the fastening head 36 from being forced through the opening 16'. In this position, the bearing surface 34 is substantially parallel to the wall 16 and the retaining pin 40 is retained in the opening 32 to ensure positive alignment therein. As the bolt is advanced, the anchor bar 28 is drawn toward the fastening head 36 as the flexible strap 44 collapses about itself. The anchor bar 28 and the block **33*a* straightens out through the hinge 48. The bolt 22 is advanced until the anchor bar 28 and the block 33*a* abut the wall 16 and the retaining pin 40 extends completely through the opening 32 as seen in FIG. 6. When the fastener 12 is fully installed (FIGS. 1 and 6) the flexible strap 44 is completely collapsed upon itself and the anchor bar 28 is fully straightened. The bolt 22 is then removed but the fastener 12 remains in the collapsed position due to the frictional engagement of the retaining pin 40 within the opening 32. The anchor bar 28 and the block 33*a* provide a substantial bearing surface against the wall 16 on each side of the opening 16' to react against forces applied thereto through the hand rail 14**.

The hand rail 14 is then placed over the fastener with the threaded opening 24' being aligned with the openings 30, 38. The bolt 22 is then threaded through the openings 24', 30, 38 to secure the hand rail 14 to the wall 16.

Depending on the location of the load on the hand rail 14, the fastener 12 must be positioned to provide the maximum support. For example, to position the anchor bar 28 in the position of FIG. 1, the fastening head 36 is rotated to a position where the indicator means **36*a* is horizontal and the flat side of the fastening head 36 located opposite the arcuate length of the anchor bar 28. Thus, the user can always know in which direction the anchor bar 28** extends to position the fastener accordingly depending on the load requirements on the hand rail.

Thus, the fastener 12 provides greater strength and support by providing a substantially large bearing face 34 to abut the rear surface of the thin wall 16 while the arcuate shape of the anchor bar 28 allows installation in very limited spaces.

What is claimed:

1. A fastener for mounting a hand rail on a hollow wall having an outer wall with an opening and an inner wall comprising a rigid longitudinal anchor bar having a bearing surface along the length thereof adapted to engage a back surface of the inner wall, said anchor bar having a threaded opening at one end;

a fastening head for engaging the opening in the outer wall having an opening therethrough;

screw threaded means adapted to be received through the opening in said fastening head and threaded into the threaded opening in said anchor bar such that said fastening head and said anchor bar are in spaced relation so that said anchor bar can be inserted into the opening in the outer wall and drawn toward said fastening head as the screw threaded means is advanced through the threaded opening in said anchor bar;

2. A fastener as in claim 1 wherein said screw threaded means is a bolt.

3. A fastener as in claim 1 comprising retaining means on said anchor bar and said fastening head for connecting and maintaining said fastening head and said anchor bar together when the bearing surface on said anchor bar is engaged with the back surface of the outer wall.

4. A fastener as in claim 3 wherein said retaining means comprises a retaining pin extending from a bottom surface of said fastening head; and wherein said anchor bar has a retaining hole adjacent the threaded opening adapted to receive said retaining pin to maintain said anchor bar and said fastening head in spaced relation and ensure positive alignment therebetween as said bolt is advanced in the threaded opening.

5. A fastener as in claim 1 comprising indicator means on said fastening head to indicate the position of said anchor bar behind the outer wall.

6. A fastener as in claim 5 wherein said indicator means is in alignment with a longitudinal axis of said anchor bar.

7. A fastener as in claim 1 wherein said fastening head has an outer flange about a substantial portion of a periphery thereof for engaging an outer surface of the outer wall when said fastening head is positioned within the opening in the outer wall.

8. A fastener as in claim 1 wherein said fastening head is D-shaped.

9. A fastener as in claim 1 wherein said anchor bar and said fastening head are integral.

10. A fastener as in claim 1 wherein said anchor bar and said fastening head are made of plastic.

11. A fastener as in claim 1 including means interconnecting said fastening head and said anchor bar.

12. A fastener as in claim 1 comprising a thin flexible strap having a first end integral with said anchor bar at one end thereof adjacent the threaded opening and a second end integral with said fastening head, such that as the screw threaded means is advanced, said flexible strap collapses upon itself as said anchor bar is drawn toward said fastening head.

13. A fastener as in claim 12 wherein said anchor bar has a slot adjacent the threaded opening in said anchor bar forming a flexible hinge and defining a rigid block adjacent said flexible strap.

14. A fastener as in claim 12 wherein said fastening head, said anchor bar and said flexible strap are plastic.

15. A fastener as in claim 12 wherein said fastening head, said anchor bar and said flexible strap are integral.

16. A fastener for mounting a hand rail on a hollow wall having an outer wall with an opening and an inner wall comprising a rigid longitudinal anchor bar having a bearing surface along the length thereof adapted to engage a back surface of the inner wall, said anchor bar having a threaded opening at one end;

a fastening head for engaging the opening in the outer wall having an opening therethrough;

screw threaded means adapted to be received through the opening in said fastening head and threaded into the threaded opening in said anchor bar such that said fastening head and said anchor bar are in spaced relation so that said anchor bar can be inserted into the opening in the outer wall and drawn toward said fastening head as the screw threaded means is advanced through the threaded opening in said anchor bar;

retaining means on said anchor bar and said fastening head for connecting and maintaining said fastening head and said anchor bar together when the bearing surface on said anchor bar is engaged with the back surface of the outer wall;

said retaining means comprising a retaining pin extending from a bottom surface of said fastening head; and said anchor bar having a retaining hole adjacent the threaded opening adapted to receive said retaining pin to maintain said anchor bar and said fastening head in spaced relation and ensure positive alignment therebetween as said bolt is advanced in the threaded opening.

17. A fastener as in claim 16 wherein said anchor bar and said fastening head are integral.

18. A fastener as in claim 16 wherein said anchor bar and said fastening head are made of plastic.

19. A fastener for mounting a hand rail on a hollow wall having an outer wall with an opening and an inner wall comprising a rigid longitudinal anchor bar having a bearing surface along the length thereof adapted to engage a back surface of the inner wall, said anchor bar having a threaded opening at one end;

a fastening head for engaging the opening in the outer wall having an opening therethrough;

screw threaded means adapted to be received through the opening in said fastening head and threaded into the threaded opening in said anchor bar such that said fastening head and said anchor bar are in spaced relation so that said anchor bar can be inserted into the opening in the outer wall and drawn toward said fastening head as the screw threaded means is advanced through the threaded opening in said anchor bar; and said anchor bar having a slot adjacent the threaded opening in said anchor bar forming a flexible hinge and defining a rigid block adjacent a flexible strap.

* * * * *